US006071435A

United States Patent [19]

Komiyama et al.

[11] Patent Number: 6,071,435

[45] **Date of Patent: *Jun. 6, 2000**

[54] COMPOSITION AND PROCESS FOR TREATING A ZINCIFEROUS SURFACE

[75] Inventors: Shinobu Komiyama, Tokyo; Kyosuke Hori; Kenji Aizawa, both of Kanagawa-Ken, all of Japan

[73] Assignee: Henkel Corporation, Gulph Mills, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/569,177

[22] PCT Filed: Jun. 23, 1994

[86] PCT No.: PCT/US94/07003

§ 371 Date: Dec. 22, 1995

§ 102(e) Date: Dec. 22, 1995

[87] PCT Pub. No.: WO95/00680

PCT Pub. Date: Jan. 5, 1995

[30] Foreign Application Priority Data

Jun. 25, 1993 [JP] Japan ..... 5-155184

[51] Int. Cl.[7] ..... C09K 3/00; C04B 9/02; C23F 11/18; C23C 22/02

[52] U.S. Cl. ..... 252/389.5; 252/389.23; 252/389.53; 252/389.24; 422/18; 422/19; 106/14.12; 106/14.44; 148/248; 148/251

[58] Field of Search ..... 148/248, 251; 252/389.53, 389.24, 389.5, 389.23; 422/18, 19, 7; 106/14.12, 14.44

[56] References Cited

U.S. PATENT DOCUMENTS 5,449,415 9/1995 Dolan ..... 148/259

FOREIGN PATENT DOCUMENTS 89-053353 11/1989 Japan .
91-049982 7/1991 Japan .

*Primary Examiner*—C. H. Kelly
*Attorney, Agent, or Firm*—Wayne C. Jaeschke; Norvell E. Wisdom, Jr.; Wayne C. Jaeschke, Jr.

[57] ABSTRACT

To inhibit the blackening of zinciferous metal-plated steel sheet while also generating a good corrosion resistance, fingerprint resistance, and chromium fixation ratio for the steel sheet, it is coated with an aqueous liquid composition that has a pH not exceeding 2.5 and contains hexavalent chromium ion, trivalent chromium ion, nickel ion, inorganic acid (preferably phosphoric acid), and film-forming resin, with a weight ratio between the nickel content and the total chromium content of 0.05 to 1, and the liquid coating is dried onto the treated metalsurface to form a blackening resistant coating that contains from 0.1 to 10 $g/m^2$ resin and from 2 to 150 $mg/m^2$ of total chromium.

7 Claims, No Drawings

COMPOSITION AND PROCESS FOR TREATING A ZINCIFEROUS SURFACE

TECHNICAL FIELD

The invention relates to a composition and process for treating the surface of zinciferous metal, particularly of steel sheet coated with zinciferous metal. The invention will be generally illustrated below by use of metal-plated steel sheet, but other zinciferous surfaces are equally suited to treatment according to the invention.

More specifically, the invention relates to a composition and process, for treating the surface of zinciferous metal-plated steel sheet, that are capable of inhibiting both the development of white rust and the development of blackening on the surface of zinciferous metal-plated steel sheet.

In this application, zinciferous metal-plated steel sheet is a general designation for steel sheet that is plated with zinc or zinc alloy. Said zinc alloy encompasses, for example, zinc/aluminum alloys, which may additionally contain one or more of iron, magnesium, manganese, silicon, titanium, nickel, cobalt, molybdenum, lead, tin, chromium, and rare earths such as La, Ce, Y, and Nb.

BACKGROUND ART

Zinciferous metal-plated steel sheet has an excellent corrosion resistance and for this reason is widely used in applications such as, for example, building materials, household electrical appliances, and automobiles. Zinciferous metal plated steel sheet is frequently not painted when used as a structural member or as an interior component of household electrical appliances.

Zinciferous metal-plated steel sheet is ordinarily subjected to a chromate treatment in the case of such unpainted service in order to inhibit white rust. A surface-treatment process has also recently appeared that uses a resin containing chromate treatment bath. This process increases the added value by increasing the corrosion resistance, pressability, fingerprint resistance, and chromium fixation ratio of zinciferous metal-plated steel sheet.

However, when unpainted zinciferous metal-plated steel sheet that has been subjected to a conventional surface treatment as described above is used or stored in the atmosphere or in a very humid environment, its surface develops a gray/black appearance and its commercial value is strongly diminished as a result. This phenomenon is known as blackening. Blackening leads merely to a change in the appearance of zinciferous metal-plated steel sheet, but leaves its other properties almost unaltered. A vexing problem posed by blackening is that it tends to develop more readily as the corrosion resistance of the material increases.

Various processes for preventing blackening have already been proposed. For example, Japanese Patent Publication Number Hei 1-53353 [53,353/1989] teaches a process for treating the surface of Zn/Al alloy-plated steel sheet in order to prevent blackening. This process uses a treatment bath that contains chromic acid and/or chromate salt in combination with water soluble resin or emulsified resin. However, the results afforded by this process are still not completely satisfactory.

Japanese Patent Publication Number Hei 3-49982 [49,982/1991] also discloses a process for preventing blackening. In this process, hot-dip zinciferous metal-plated steel sheet is first treated with a bath that contains Co ion and/or Ni ion in order to deposit these metals on the surface. The surface of the sheet is then subjected to a chromate treatment. This process, however, consists of a two-step method (Ni and/or Co plating treatment and chromate treatment) or a three-step method (the preceding plus a water wash after the Ni and/or Co plating treatment) and is therefore difficult to implement in existing surface treatment facilities.

DISCLOSURE OF THE INVENTION

Problems to be Solve by the Invention

In order to solve the problems described above for the heretofore known surface treatment agents and treatment processes for the purpose of blackening inhibition, the present invention seeks to introduce a surface-treatment composition and a surface-treatment process that can impart an excellent corrosion resistance, excellent pressability, excellent fingerprint resistance, and high chromium fixation ratio to zinciferous metal-plated steel sheet and that, by a simple procedure, can form thereon a surface coating layer that strongly inhibits blackening.

SUMMARY OF THE INVENTION

The inventors have found that the problems described above can be eliminated by the addition of trivalent chromium ion and nickel ion to a ($Cr^{6+}$+resin) containing aqueous surface-treatment composition for application to zinciferous metal-plated steel sheet and by controlling the nickel content therein to specific proportions. The present invention was achieved based on this discovery.

In specific terms, a composition according to the invention for treating the surface of zinciferous metal-plated steel sheet is a liquid aqueous composition that has a pH not exceeding 2.5 and that comprises, preferably consists essentially of, or more preferably consists of, hexavalent chromium ion, trivalent chromium ion, nickel ion, inorganic acid, and resin material composed of at least 1 type of water-based emulsified resin, with the characteristic feature that the nickel content therein is adjusted so as to give a weight ratio between the nickel content and the total chromium content of 0.05 to 1.

A process of the present invention for treating the surface of zinciferous metal-plated steel sheet characteristically comprises steps of:

(I) application to the surface of zinciferous metal-plated steel sheet of a liquid coating of an aqueous surface treatment agent according to the invention as otherwise described herein;

and (II) subsequently drying the liquid film of the aqueous surface treatment agent applied in step (I) in order thereby to form on the treated metal a blackening resistant dry coating layer, which preferably contains 0.1 to 10 $g/m^2$ of the aforesaid resin material and 2 to 150 $mg/m^2$ of total chromium.

DETAILED OF PREFERRED EMBODIMENTS

The inorganic acid used in the present invention preferably consists of one or more selections from phosphoric acid, nitric acid, fluosilicic acid, fluozirconic acid, boric acid, and fluoboric acid. The nickel ion is preferably supplied by addition to the subject aqueous composition of one or more nickel compounds selected from nickel carbonate, nickel oxide, and nickel hydroxide. The aforementioned resin material preferably includes at least 1 selection from water-based emulsified polyacrylic resins and water-based emulsified polyurethane resins. The inorganic acid is preferably phosphoric acid, and the phosphoric acid content, which is to be understood for this purpose as the stoichiometric equivalent as phosphoric acid of not only any undissociated phosphoric acid present in the solution but also of any phosphorus containing anions produced by any degree of ionization of phosphoric acid, is preferably from 5 to 30 times (on a weight basis) of the nickel content.

The hexavalent chromium ion present in the surface-treatment composition of the present invention can be supplied by addition to the aqueous composition of one or more selections from among the hexavalent chromium compounds heretofore used for chromate treatment baths, for example, chromic acid, chromic anhydride, chromate salts (e.g., ammonium chromate), and dichromate salts (e.g., ammonium dichromate). The hexavalent chromium ion acts to improve the corrosion resistance conferred on zinciferous metal-plated steel sheet by the surface coating layer afforded by the present invention.

The trivalent chromium ion present in the surface-treatment composition of the present invention can be supplied by reduction of hexavalent chromium ion and/or by addition to the aqueous composition of at least 1 trivalent chromium compound, for example, chromium phosphate, chromium nitrate, or chromium hydroxide. The trivalent chromium ion is the component effective for increasing the chromium fixation ratio in the surface coating layer afforded by the present invention on zinciferous metal-plated steel sheet.

The nickel ion used in the present invention may be supplied by the addition of nickel chromate or nickel dichromate to the aqueous composition, but is preferably supplied by the addition of at least 1 nickel compound selected from nickel carbonate, nickel oxide, and nickel hydroxide. A particularly important feature of the present invention is that the nickel ion does not impair the excellent properties of zinciferous metal-plated steel sheet, while at the same time it is particularly effective for inhibiting the blackening associated with resin containing chromate treatment systems. Other metal ions, for example, even cobalt ions, do not exhibit this anti-blackening activity.

The inorganic acid used in the present invention is selected from inorganic acids that are capable of adjusting the pH of the aqueous surface treatment composition to 2.5 or below and preferably consists of at least 1 selection from phosphoric acid, nitric acid, fluosilicic acid, fluozirconic acid, boric acid, and fluoboric acid. Among these inorganic acids, the use of phosphoric acid is preferred. Satisfactorily achieving the desired anti-blackening activity becomes highly problematic when the pH of the surface-treatment composition exceeds 2.5.

The resin material used by the present invention comprises at least 1 type of water-based emulsified resin and has the capacity to form a film. This resin material should be selected from those that are stable (i.e., exhibit no gelation or precipitation) even at pH $\leqq 2.5$ and that resist oxidation by the chromic acid, dichromic acid, or salts thereof present in the surface-treatment composition. The subject resin material should be selected as is appropriate, as a function of the stability desired for the surface-treatment composition, but in general preferably includes at least 1 selection from water-based emulsified polyurethane resins and water-based emulsified polyacrylic resins, e.g., polymers or copolymers of at least 1 selection from acrylic acid, methacrylic acid, acrylonitrile, acrylates (e.g., n-butyl acrylate, 2-ethylhexyl acrylate, etc.), methacrylates (e.g., methyl methacrylate, methoxyethylene methacrylate, etc.), styrene, and the like. These resins exhibit an excellent weather resistance and fingerprint resistance and are highly adherent for a variety of paint films. The resin material may contain water-soluble resin.

The hexavalent chromium ion concentration and trivalent chromium ion concentration in the surface-treatment composition of the present invention are each preferably 2 to 5 g/L. The nickel ion concentration is preferably 1 to 3 g/L. The inorganic acid is preferably present in the quantity necessary to adjust the pH of the aqueous composition to $\leqq 2.5$, for example, 3 to 10 g/L.

The resin material is preferably present in the surface-treatment composition of the present invention at a concentration of 100 to 300 g/L as weight of solids.

The nickel content in the surface-treatment composition of the present invention is adjusted so as to give a weight ratio between the nickel content and the total chromium content of 0.05 to 1. The anti-blackening activity is inadequate when this parameter is less than 0.05, while the corrosion resistance becomes unsatisfactory when this parameter exceeds 1.

The inorganic acid content in the surface-treatment composition of the present invention is preferably from 5 to 30 times (on a weight basis) that of the nickel. Adjusting the inorganic acid/nickel weight ratio in this manner affords the maximum level of anti-blackening activity.

In a process according to the invention, the aqueous surface-treatment agent as described above is coated on the surface of zinciferous metal-plated steel sheet and is then solidified by drying. No particular limitations apply to the application technique, and typical application techniques, for example, roll coating, roll squeegee coating, and so forth, can be used here. The technique for drying/solidification is also not specifically restricted, and hot-air drying, infrared drying, etc., can be used. Hot-air temperatures of 100° C. to 400° C. are preferred, or the steel sheet can be heated to 60° C. to 250° C.

The surface-treatment composition preferably should be applied in the invention process so as to yield a resin material content of 0.1 to 10 g/m$^2$, more preferably 0.5 to 3 g/m$^2$, and a total chromium content of 2 to 150 mg/m$^2$ and preferably 10 to 70 mg/m$^2$ in the blackening-resistant coating layer formed by drying and solidification.

The fingerprint resistance becomes inadequate when the resin material content falls below 0.1 g/m$^2$. On the other hand, the final product has a reduced weldability and the economics become undesirable when the resin material content exceeds 10 g/m$^2$. The anti-corrosion activity of the final coating layer is inadequate when the total chromium content falls below 2 mg/m$^2$, while a total chromium content in excess of 150 mg/m$^2$ results in an unsatisfactory blackening inhibition by the final coating layer and also results in a reduced chromium fixation ratio.

In addition to the components described above, the surface-treatment composition in accordance with the present invention may contain, for example, cobalt ion, manganese ion, zinc ion, $SiO_2$, nitrate ion, and/or ammonium ion.

EXAMPLES

The present invention is described in greater detail by the following working examples. Product performance was evaluated by the following tests in the working and comparative examples that follow.

(a) Blackening Test

The test specimen was held for 24 hours in a humidity tester at 80° C. and 98 % relative humidity, and the change in the lightness (ΔL) before and after testing was measured with a color difference meter and scored on the following scale:

| Symbol | Change in Lightness (ΔL) |
|---|---|
| ++ | less than 8 (passes) |
| + | from 8 up to but not including 12 (passes) |
| x | 12 or more (fails) |

(b) Corrosion Resistance

The test sample was subjected to salt-spray testing for 240 hours in accordance with JIS Z 2371. It was then visually inspected and the area of white rust development was scored on the following scale:

| Symbol | Area of White Rust Development |
|---|---|
| ++ | less than 5% (passes) |
| + | from 5% up to but not including 20% (passes) |
| x | 20% or more (fails) |

(c) Fingerprint Resistance

A finger was pressed against the test specimen and the resulting fingerprint impression was visually inspected and scored on the following scale:

| Symbol | Fingerprint Impression |
|---|---|
| ++ | almost not visible (passes) |
| + | slightly visible (passes) |
| x | clearly visible (fails) |

(d) Cr Fixation Ratio

The Cr add-on was measured before and after subjecting the test specimen to alkaline degreasing. Alkaline degreasing consisted of a 2 minute spray at 60° C. with 2 % aqueous FINECLEANER™ 4326T from Nihon Parkerizing Company, Limited. The proportion of Cr remaining on the test specimen was calculated and scored on the following scale:

| Symbol | Residual Cr Ratio |
|---|---|
| ++ | 85% or more (passes) |
| + | from 60% up to but not including 85% (passes) |
| x | less than 60% (fails) |

Examples 1 to 21 and Comparative Examples 1 to 8

Examples 1 to 21 and Comparative Examples 1 to 8 used steel sheet specimens selected as reported in Tables 1 and 2 from steel sheets (A), (B), and (C) described below, all with plating weight=90 g/m$^2$:

(A) hot-dip zinc-plated steel sheet (B) steel sheet plated with 55 % Al/Zn alloy (C) steel sheet plated with 5 % Al/Zn alloy.

The surface-treatment compositions were prepared using the components described below.

| Component | Quantity in g/L |
|---|---|
| chromic anhydride (hexavalent chromium compound) | 0.2 to 35 (as hexavalent chromium) |
| reduced chromium (trivalent chromium compound) | 0.1 to 20 (as trivalent chromium) |
| nickel carbonate (nickel compound) | 0.2 to 10 (as nickel) |
| phosphoric acid | 1 to 50 |
| resin | 100 to 300 |
| aqueous ammonia | for pH adjustment |

Tables 1 and 2 report the phosphoric acid/nickel weight ratio, pH, and type of resin for the surface-treatment compositions in the respective examples and comparative examples. The following resins were used:

Resin A=styrene/n-butyl acrylate copolymer resin in water-based emulsion form

Resin B=polyurethane resin in water-based emulsion form.

In each example and comparative example, the surface-treatment composition was applied to the plated steel sheet specimen by roll coating. A solid dry coating layer was then produced by drying and solidification of the liquid coating layer by raising the temperature of the plated steel sheet specimen to 100° C. using hot air. The resin add-on and Cr add-on were measured on the resulting product, which was also subjected to the tests described above. These results are reported in Tables 1 and 2.

Benefits of the Invention

The composition and process of the present invention for treating the surface of zinciferous metal-plated steel sheet can prevent the blackening of this type of plated steel sheet while providing an excellent corrosion resistance, fingerprint resistance, and chromium fixation ratio.

TABLE 1

| Example Number | Test Substrate | Chromate Treatment Bath Characteristics: Ni/Cr | $PO_4^{-3}$/Ni | pH | Resin |
|---|---|---|---|---|---|
| 1 | A | 60/100 | 5 | 2–2.5 | Resin A |
| 2 | A | 40/100 | 5 | 2–2.5 | Resin A |
| 3 | A | 20/100 | 5 | 2–2.5 | Resin A |
| 4 | A | 20/100 | 5 | 2–2.5 | Resin A |
| 5 | A | 20/100 | 5 | 2–2.5 | Resin A |
| 6 | A | 20/100 | 5 | 2–2.5 | Resin A |
| 7 | A | 60/100 | 5 | 2–2.5 | Resin A |
| 8 | A | 20/100 | 5 | 2–2.5 | Resin A |
| 9 | A | 10/100 | 5 | 2–2.5 | Resin A |
| 10 | A | 40/100 | 5 | 1–1.5 | Resin A |
| 11 | A | 40/100 | 5 | ≦1 | Resin A |
| 12 | A | 20/100 | 10 | ≦1 | Resin A |
| 13 | B | 20/100 | 10 | ≦1 | Resin A |
| 14 | C | 20/100 | 10 | ≦1 | Resin A |
| 15 | A | 10/100 | 30 | ≦1 | Resin A |
| 16 | A | 20/100 | 10 | ≦1 | Resin B |
| 17 | A | 20/100[1] | 10 | ≦1 | Resin A |
| 18 | A | 20/100[2] | 10 | ≦1 | Resin A |
| 19 | A | 20/100[3] | 10 | ≦1 | Resin A |
| 20 | A | 20/100[4] | 10 | ≦1 | Resin A |
| 21 | A | 20/100[5] | 10 | ≦1 | Resin A |

TABLE 1-continued

| Example Number | Add-On Mass of: Resin, g/m² | Add-On Mass of: Cr, mg/m² | Resistance to: Black-ening | Resistance to: Corrosion | Resistance to: Finger-prints | Cr Fixation Ratio |
|---|---|---|---|---|---|---|
| 1 | 0.2 | 5 | ++ | + | + | ++ |
| 2 | 0.2 | 50 | + | ++ | + | ++ |
| 3 | 0.2 | 100 | + | ++ | + | + |
| 4 | 1.0 | 50 | + | ++ | ++ | ++ |
| 5 | 2.0 | 50 | + | ++ | ++ | ++ |
| 6 | 3.0 | 50 | + | ++ | ++ | ++ |
| 7 | 5.0 | 5 | ++ | + | ++ | ++ |
| 8 | 5.0 | 50 | + | ++ | ++ | ++ |
| 9 | 5.0 | 100 | + | ++ | ++ | + |
| 10 | 1.0 | 50 | ++ | ++ | ++ | ++ |
| 11 | 1.0 | 50 | ++ | ++ | ++ | ++ |
| 12 | 1.0 | 50 | ++ | ++ | ++ | ++ |
| 13 | 1.0 | 50 | ++ | ++ | ++ | ++ |
| 14 | 1.0 | 50 | ++ | ++ | ++ | ++ |
| 15 | 1.0 | 50 | ++ | ++ | ++ | ++ |
| 16 | 1.0 | 50 | ++ | ++ | ++ | ++ |
| 17 | 1.0 | 50 | + | ++ | ++ | ++ |
| 18 | 1.0 | 50 | + | ++ | ++ | ++ |
| 19 | 1.0 | 50 | + | ++ | ++ | ++ |
| 20 | 1.0 | 50 | + | ++ | ++ | ++ |
| 21 | 1.0 | 50 | ++ | ++ | ++ | ++ |

[1]Same composition as Example 12 except for the addition of cobalt carbonate in a quantity equimolar to the nickel content.
[2]Same composition as Example 12 except for the addition of manganese carbonate in a quantity equimolar to the nickel content.
[3]Same composition as Example 12 except for the addition of zinc carbonate in a quantity equimolar to the nickel content.
[4]Same composition as Example 12 except for the addition of cobalt nitrate in a quantity equimolar to the nickel content.
[5]Same composition as Example 12 except for the addition of silicon dioxide in a quantity equal to ten (10) times the weight of the nickel content.

TABLE 2

| Comparative Ex. No. | Test Substrate | Chromate Treatment Bath Characteristics: Ni/Cr | $PO_4$/Ni | pH | Resin | Add-On Masses: Resin g/m² | Add-On Masses: Cr mg/m² | Resistance to: Blackening | Resistance to: Corrosion | Resistance to: Finger-prints | Cr Fixation Ratio |
|---|---|---|---|---|---|---|---|---|---|---|---|
| 1 | A | 10/100 | 6 | 2.5–3.0 | A | 1.0 | 50 | x | ++ | ++ | ++ |
| 2 | A | 10/100 | 4 | 2–2.5 | A | 1.0 | 50 | x | ++ | ++ | ++ |
| 3 | A | 2/1 | 2 | 2–2.5 | A | 1.0 | 50 | x | + | ++ | ++ |
| 4 | A | Note 6 | — | ≦1 | A | 1.0 | 50 | x | ++ | ++ | ++ |
| 5 | B | Note 7 | — | ≦2 | A | 1.0 | 50 | x | ++ | ++ | ++ |
| 6 | C | Note 8 | — | ≦2 | A | 1.0 | 50 | x | ++ | ++ | ++ |
| 7 | A | Note 9 | — | ≦1 | A | 1.0 | 50 | x | ++ | ++ | ++ |
| 8 | A | Note 10 | — | ≦1 | A | 1.0 | 50 | x | ++ | ++ | ++ |

Note 6: A composition like Example 12 except without the addition of nickel.
Note 7: A composition like Example 12 except without the nickel compound, phosphoric acid, and trivalent chromium compound.
Note 8: A composition like Example 12 except without the nickel compound, phosphoric acid, and trivalent chromium compound.
Note 9: A composition like Example 12 except that the nickel compound has been replaced by an equimolar quantity of the corresponding cobalt compound.
Note 10: A composition like Example 12 except that the nickel compound has been replaced by an equimolar quantity of the corresponding zinc compound.

The invention claimed is:

1. An aqueous liquid composition for treating the surface of zinciferous metal, said aqueous liquid composition having a pH not exceeding 2.5 and consisting essentially of water and:

(A) ions containing hexavalent chromium, (B) trivalent chromium ions, (C) nickel ions, (D) phosphoric acid, and (E) a water-based emulsified resin, wherein there is a weight ratio between the nickel content and the total chromium content in the range from 0.05 to 1.0 and there is a ration by weight of phosphoric acid to nickel in the range form 5 to 30.

2. A composition according to claim 2, wherein resin component (E) is selected from the group consisting of water-based emulsified polyacrylic resins and water-based emulsified polyurethane resins and the concentration of solids in component (E) in the composition is from 100 to 300 g/L.

3. A composition according to claim 2 wherein the concentrations of each of components (A) and (B) are from 2 to 5 g/L, the nickel ion concentration is from 1 to 3 g/L, and the concentration of phosphoric acid is from 3 to 10 g/L.

4. A composition according to claim 1, wherein the concentrations of each of components (A) and (B) are from 2 to 5 g/L, the nickel ion concentration is from 1 to 3 g/L, and the concentration of phosphoric acid is from 3 to 10 g/L.

5. A process of treating a zinciferous surface with an aqueous liquid composition according to claim 4 and subsequently drying, so as to deposit on said zinciferous surface, from the solids content of said aqueous liquid composition, a solid dry coating layer containing from 0.1 to 10 g/m² of resin solids and from 2 to 150 mg/m² of total chromium.

6. A process to claim 5, wherein the solid dry coating layer contains from 0.5 to 3 g/m² of resin solids and from 10 to 70 mg/m² of total chromium.

7. A process of treating a zinciferous surface with an aqueous liquid composition according to claim 1 and subsequently drying, so as to deposit on said zinciferous surface, from the solids content of said aqueous liquid composition, a solid dry coating layer containing from 0.1 to 10 g/m² of resin solids and from 2 to 150 mg/m² of total chromium.

* * * * *